US006520055B1

(12) United States Patent
Reusch et al.

(10) Patent No.: US 6,520,055 B1
(45) Date of Patent: Feb. 18, 2003

(54) SCREWDRIVER OR SCREWDRIVER ATTACHMENT

(75) Inventors: Andreas Reusch, Remscheid (DE); Giuseppe De Bona, Remscheid (DE)

(73) Assignee: Wera Werk Hermann Werner GmbH & Co., Wuppertal (DE)

( * ) Notice: Subject to any disclaimer, the term of this patent is extended or adjusted under 35 U.S.C. 154(b) by 0 days.

(21) Appl. No.: 09/319,523

(22) PCT Filed: Nov. 29, 1997

(86) PCT No.: PCT/EP97/06661

§ 371 (c)(1),
(2), (4) Date: Aug. 9, 1999

(87) PCT Pub. No.: WO98/24597

PCT Pub. Date: Jun. 11, 1998

(30) Foreign Application Priority Data

Dec. 5, 1996 (DE) ..... 296 21 122 U
Sep. 3, 1997 (DE) ..... 297 15 772 U

(51) Int. Cl.[7] ..... B25B 23/00
(52) U.S. Cl. ..... 81/460; 81/436
(58) Field of Search ..... 81/436, 460

(56) References Cited

U.S. PATENT DOCUMENTS 2,847,894 A * 8/1958 Smith et al. ..... 81/460 X
2,848,024 A 8/1958 Smith
3,025,896 A * 3/1962 Muenchinger ..... 81/460
3,037,539 A * 6/1962 Johnson et al. ..... 81/460
3,234,982 A 2/1966 Stillwagon
4,187,892 A * 2/1980 Simmons ..... 81/460 X
4,998,454 A * 3/1991 Chaconas et al. ..... 81/436

FOREIGN PATENT DOCUMENTS

DE 195189 * 1/1958 ..... 81/460
DE 1921514 10/1970
FR 1213166 3/1960
GB 446714 5/1936

* cited by examiner

*Primary Examiner*—D. S. Meislin
(74) *Attorney, Agent, or Firm*—Martin A. Farber

(57) ABSTRACT

The invention relates to a screwdriver or screwdriver attachment (S) comprising one input and one output end (1 and 2) and a shank (4) located in between the two. The output end has at least three, preferably four, ribs (7) which radiate outwards from a central section (8) located around the axis of rotation (x—x). The ribs (7) on each end side have a face, which is placed at an angle to the axis of rotation, and flanks on the front and back side (13, 14) which run substantially parallel to each other in the area next to the frontal face (11). In this area the flank (13) on the front side is located on a diametrical surface (diameter D—D) in relation to the axis of rotation (x—x), whereby the flanks (13, 14) of adjoining ribs (7) form a groove (9) which runs lengthways and whose root (16) ends in the outer surface of a section of the shank. The invention provides a solution that is more balanced in terms of load and easier to use, by having flanks (13, 14) that are curved in such a way that they point away from each other in the direction of the axis, starting from the face area of each rib (7).

13 Claims, 8 Drawing Sheets

S
x
11
19
19
8
12
16'
19
11
y
13
13
13"
13"
14
A
13'
16
14
16
14'
14'
13'
9
9
16"
16"
20
20
5
10
x

S
D
7
12
16
14
19
7
16
XIII
XIII
x–x
z
16'
9
14
D
F2
13
A
7
14
9
16
13
8

F2
F1
x
12
19
J1
J2
7
9
14
7a
13
7
9
14
A
2
S
16''
20
16''
10
x

Fig. 13
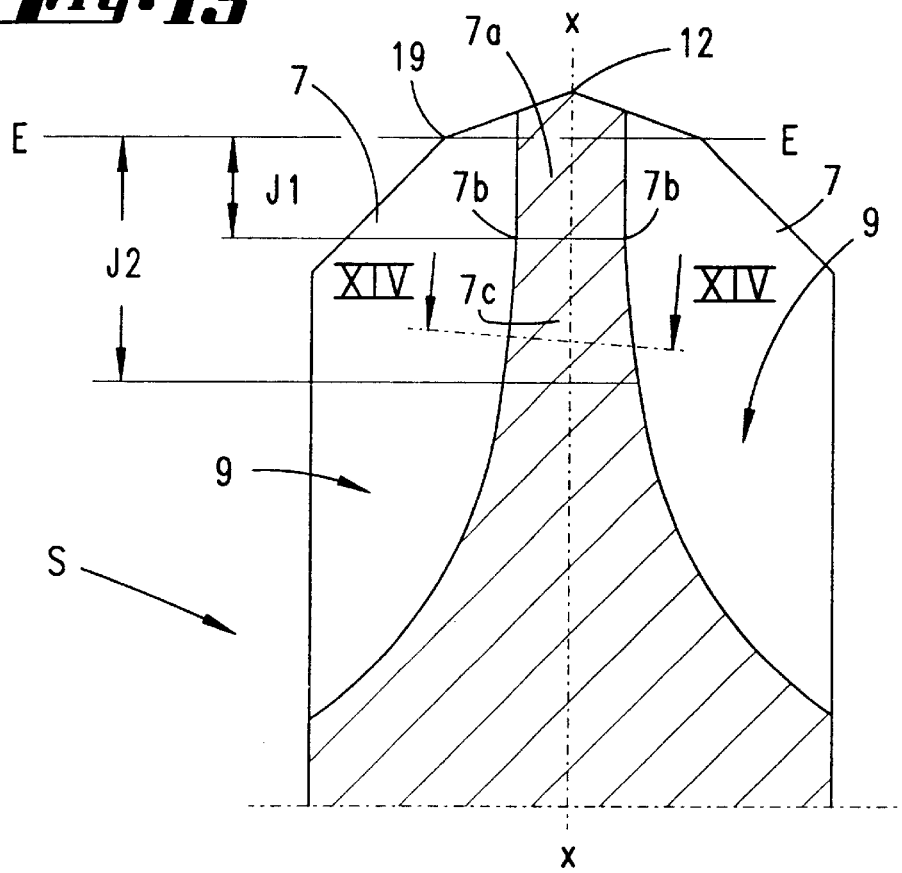
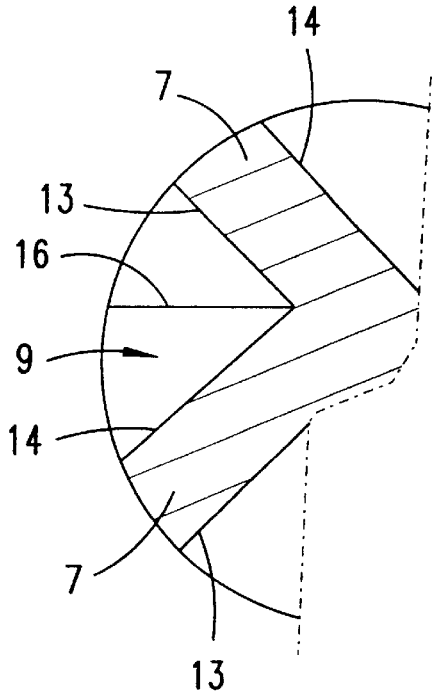
Fig. 14

SCREWDRIVER OR SCREWDRIVER ATTACHMENT

FIELD AND BACKGROUND OF THE INVENTION

The invention relates to a screwdriver or screwdriver bit, having an input end, an output end and a shank located between these ends, the output end being profiled in the form of at least three, preferably four, ribs, which ribs start, in the radial direction, from a centre section which lies around the axis of rotation, each have a front part at their end, which front part is at an angle to the axis of rotation, and form front and rear flanks which, in the region adjacent to the front part, run substantially parallel to one another, in which region the front flank lies on a diametral surface with respect to the axis of rotation, the flanks Of adjacent ribs forming a notch which runs in the longitudinal direction and has a notch base which ends by running into the circumferential surface of a shank section.

In such known screwdrivers or screwdriver bits, the ribs are centre-offset, specifically by substantially the dimension of the rib thickness. One of the flanks, specifically the frontal flank which lies on the screwing-in side, lies on a common diametral plane with the corresponding flank of the opposite rib (in the case of cross-ribbing, of course). The associated screw head is adapted to these decentralized rib entries. The adjoining rear flank in the same groove is substantially parallel over the insertion depth, but then merges into a concave rounded section, so that the notch boundary edges meet, on the circumferential wall side, at the foot of the completely planar flank. The rounded section covers a quarter-circle. This leads to considerable volumes of material being removed in the region of the base of the output end, resulting in a certain tendency towards weakness.

SUMMARY OF THE INVENTION

It is an object of the invention to provide a screwdriver or screwdriver bit of the type in question which is more stable and more advantageous in terms of its screwing performance.

This object is firstly and substantially achieved in the case of a screwdriver or screwdriver bit of this type, it being provided that the two flanks, starting from the front region of each rib, are curved away from one another in the axial direction. This results in a distribution of material in the ribs which is better able to withstand the loads. It is furthermore proposed that the notch boundary edge which faces the front flank, in the further course of the continuously curved flank section, is curved over a smaller circumferential angle than the notch boundary edge of the rear flank. This provides stable rib feet; these feet are rooted in the larger accumulation of material in the transition region with the shaft. This involves both flanks of the rib, since they are curved away from one another in the circumferential direction. By having the curvature of the front flank cover a small circumferential angle, it is possible to produce an even greater steepness, whereas the curvature of the rear flank of the rib, which curvature extends over a correspondingly greater circumferential angle, "reinforces the back", as a result of the greater accumulation of material which is formed in that region, in such a manner that it is able to withstand loads. Furthermore, curving both flanks results in an advantageous clamping action between the cross profile, i.e. output end of the screwdriver or screwdriver bit, and the cross slot of the associated screw. This screw is held in place virtually automatically, irrespective of the position.

Moreover, the correspondingly securely gripping insertion method results in high service lives, the application of a high torque and, above all, in the formation of reduced ejecting forces. In addition, it is advantageous, in the case of a screwdriver or screwdriver bit, having an input end, an output end and a shank located between these ends, the output end being profiled in the form of at least three, preferably four, ribs, which ribs start, in the radial direction, from a centre section which lies around the axis of rotation, each have a front part at their end, which front part is at an angle to the axis of rotation, and form front and rear flanks which, in the region adjacent to the front part, run substantially parallel to one another, in which region the front flank lies on a diametral surface with respect to the axis of rotation, the flanks of adjacent ribs forming a notch which runs in the longitudinal direction and has a notch base which ends by running into the circumferential surface of a shank section, if the two flanks in the front part region of each rib are curved away from one another in the circumferential direction, the notch boundary edge which faces the front flank, in the further course of the continuously curved flanks, being curved over a smaller circumferential angle than the boundary notch edge of the rear flank. Furthermore, it is proposed for the front flank to have an additional curvature about the longitudinal direction, with a projecting radially outer section of the front region of the flank. Such a configuration is even in fact of independent importance. It results from a twisting of the ribs which proceeds in the working direction and can be produced in a very wide variety of ways. This also results in flanks which are undercut in the radially inward direction in the front region. The result is an engagement point which lies well on the outside in the radial direction, precisely for screwing in screws, and is therefore particularly advantageous for leverage. Equally, it is advantageous if, in addition, the rear flank has an additional curvature about the longitudinal direction with a correspondingly dropping radially outer section of the front region. Overall, this results in a rib which fits diagonally into the corresponding slot section of the cross slot, assisting with the clamping action explained above. In addition, it is advantageous, in the case of a screwdriver or screwdriver bit, having an input end, an output end and a shank located between these ends, the output end being profiled in the form of at least three, preferably four, ribs, which ribs start, in the radial direction, from a centre section which lies around the axis of rotation, each have a front part at their end, which front part is at an angle to the axis of rotation, and form front and rear flanks which, in the region adjacent to the front part, run substantially parallel to one another, in which region the front flank lies on a diametral surface with respect to the axis of rotation, the flanks of adjacent ribs forming a notch which runs in the longitudinal direction and has a notch base which ends by running into the circumferential surface of a shank section, if the two flanks, in the front region of each rib, starting from a parallel flank section which enters into the insertion profile (cross slot) of the screw head, are curved away from one another in the axial direction, the start of the curvature lying in the region of the opening of the insertion profile. This results in an improved centring fit between screwdriver or screwdriver bit and screw head. To achieve a conical torque set tool, the further measure of having the notch base of each notch, in the front region, inclined at an acute angle to the axis of rotation has proven advantageous. This has a centring action and assists with the clamping action referred to above. Furthermore, it is proposed for the front part of the flanks to form sections of an imaginary frustoconical surface.

Furthermore, the invention proposes for the imaginary extension of the axial projection of each notch base to pass the axis of rotation at a distance therefrom. The distance approximately corresponds to the dimension of the smaller circumferential angle of the more steeply curved flank. In addition, it is proposed that the notch base ends with notch boundaries which meet at an acute angle, in which case it is advantageous for the notch boundaries to meet approximately at an angle of about 40°. Moreover, an advantageous further embodiment of the screwdriver or screwdriver bit of the type in question consists in the distance between point and beginning of curvature being less than the insertion depth of the screw head into the insertion profile. This ensures an advantageous edge contact between tool and attachment element, i.e. screw. In this case, it is advantageous for the width of the rib at the level of the profile depth of the screw head insertion profile to be greater than the width of the opening of the insertion profile. Finally, the invention proposes for the curved surfaces which adjoin the parallel flank section to be twisted. This again results in the abovementioned clamping action between the cross profile, i.e. output end of the screwdriver or screwdriver bit, and the cross slot of the associated screw. Finally, it has proven advantageous for the curved surfaces on the front and rear sides to be unevenly twisted in the same direction, in order to achieve a twisting of the ribs which is more intense at the periphery. The screw profile according to the invention is used in aerospatial engineering, where it is customary for screws to be used only once. The profile according to the invention is particularly suitable for unscrewing the screws, since the flanks of the ribs are not planar, but rather are inherently curved surfaces. The novel geometry is advantageous in particular on the flank which becomes active when unscrewing and does not run through the centre of rotation of the tool. The notch boundary associated with this flank is slightly set back from the groove base, with respect to a parallel plane through the rear flank with respect to the associated rib. The high torque which is required for unscrewing at the start of the screwing movement can be transmitted by the optimum surface-to-surface contact which the geometry produces when torque is applied. At the same time, the profile according to the invention allows the screw to be tightened at least as well as in the prior art, with the maximum torque being produced at the end of the screwing

BRIEF DESCRIPTION OF THE DRAWINGS

The subject matter of the invention is explained in more detail below with reference to an exemplary embodiment which is illustrated in the drawings, in which FIG. 13 shows the section on line XIII—XIII in FIG. 12, FIG. 14 shows the section on line XIV—XIV in FIG. 13.

DETAILED DESCRIPTION OF THE PREFERRED EMBODIMENT

Figure 1:
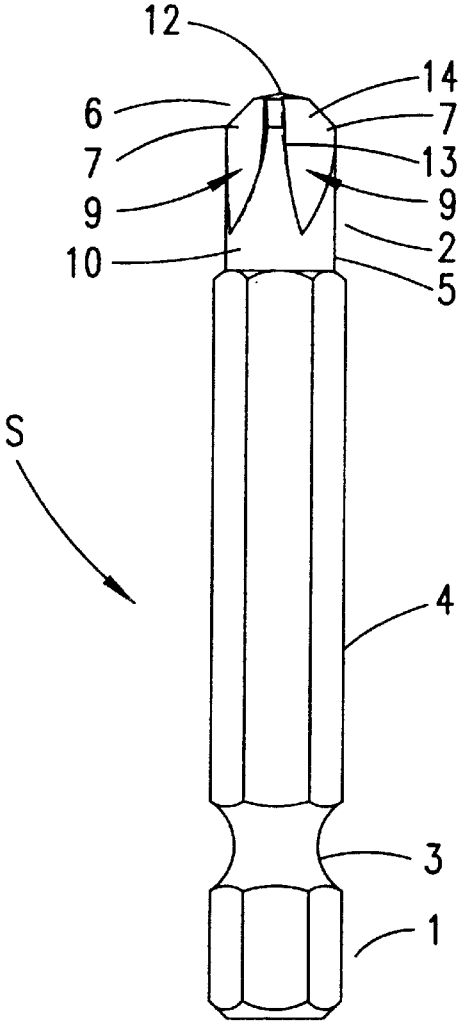
FIG. 1 shows an enlarged side view of a screwdriver bit which is designed according to the invention, FIG. 2 likewise shows an enlarged side view of a screwdriver bit, in this case according to the prior art.
Figure 2:
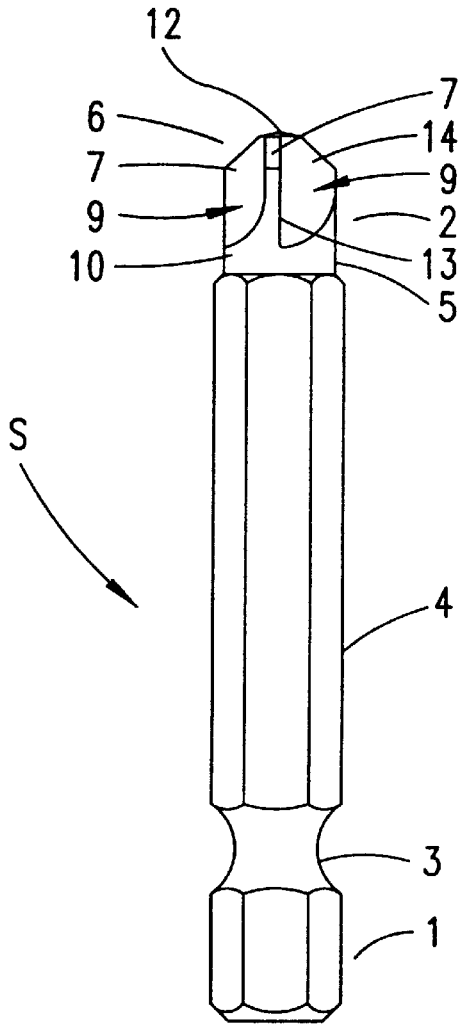
Figure 3:
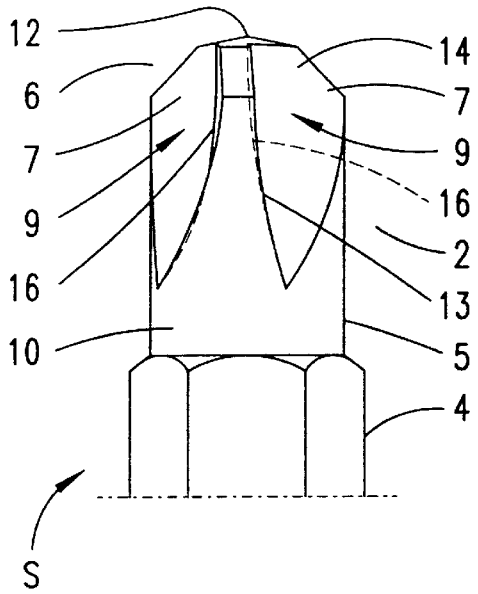
FIG. 3 shows a further enlarged view of the output end of the screwdriver bit in accordance with FIG. 1.
Figure 5:
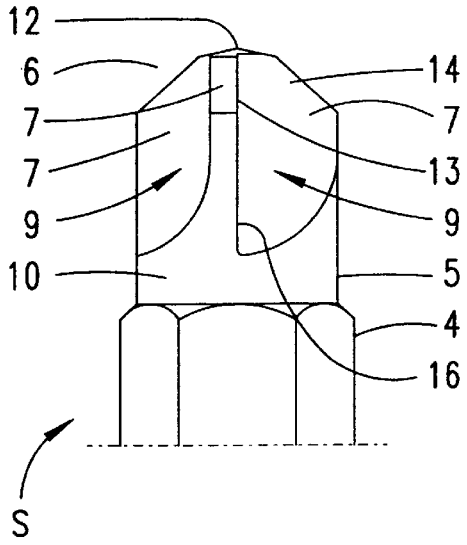
FIG. 5 shows a further enlarged view of the output end of the screwdriver bit in accordance with FIG. 2.
Figure 4:
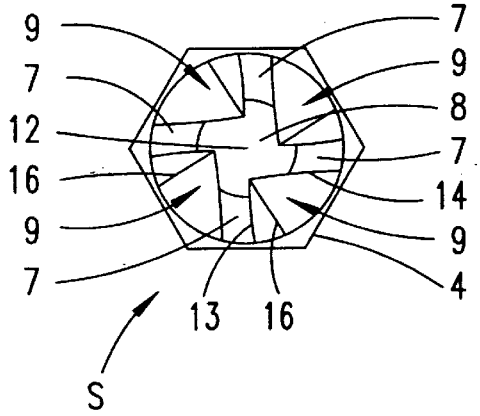
FIG. 4 shows a plan view of FIG. 3.
Figure 6:
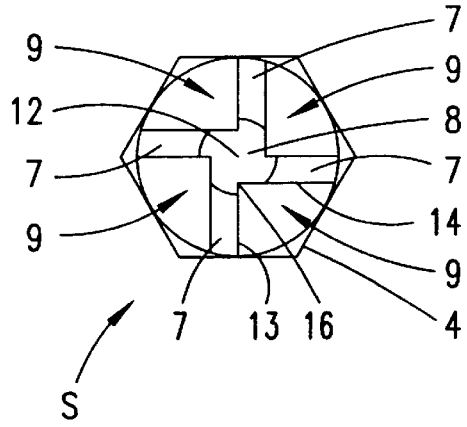
FIG. 6 shows a plan view of FIG. 5.

The screwdriver bit S illustrated is of rod-shaped design. It may therefore equally well be a screwdriver.

The screwdriver bit S has an input end 1 and an output end 2, also known as working end.

The input end 1 is provided with an annular groove 3, by means of which the tool can be axially secured, for example to a motor-operated screwdriver.

The rotational drive in a corresponding chuck is based on the non-round, specifically hexagonal cross-sectional shape of the shank 4 of the screwdriver bit S. This hexagonal cross section covers most of the length of the screwdriver bit.

The output end 2 is reduced to approximately the width across flats of the hexagonal cross section and forms a head which is of predominantly cylindrical shape, in the form of a stepped shank section 5 of the tool. The free end of the shank section 5 merges into a cross profile 6, which has four ribs 7. The ribs start from a centre section 8, which lies around the geometric axis of rotation x—x of the tool, and extend substantially radially and at equal angular spacings.

The gaps between the ribs 7 of the cross profile 6 are formed as notches 9, specifically asymmetric V-notches. These notches extend far beyond the engagement depth y of the cross profile 6, in the direction of the shank 4. They end in a base region 10, which is itself notch-free, of the shank section 5. The ratio of the length of base region 10 to that of the notched zone is approximately 1:4.

The front part of the ribs 7, which are provided substantially on the periphery of the centre section 8, are at an angle to the axis of rotation x—x. At least to some extent, a partial section of the front part 11 merges in rib form into the centre section 8, which is of frustoconical shape. A cone vertex 12 coincides with the axis of rotation x—x.

The ribs 7 each define a front flank 13 and a rear flank 14, with regard to the direction in which a screw 15 is screwed in clockwise. When seen in cross section, they run, very roughly, parallel to one another (cf. FIG. 8).

Taking into consideration a suitably extensive centre offset of the ribs 7, the result is that the front flanks 13 of opposite ribs 7 are aligned substantially in one diametral plane D—D. Thus in practice, with respect to the axis of rotation x—x, the result is diametral surfaces.

The centre offset and the equal width of the ribs 7, given equal radial distance of the notch base 16 of the notches 9, enables flanks 13, 14 of different widths to be provided. The front flanks (13) are shorter in the radial direction. The ratio is in the region of 1:1.5 (cf. FIG. 8).

In the prior art, the notch base 16 forms the transition from the inner edge of the uncurved flank 13 to the curved flank 14.

Figure 7:
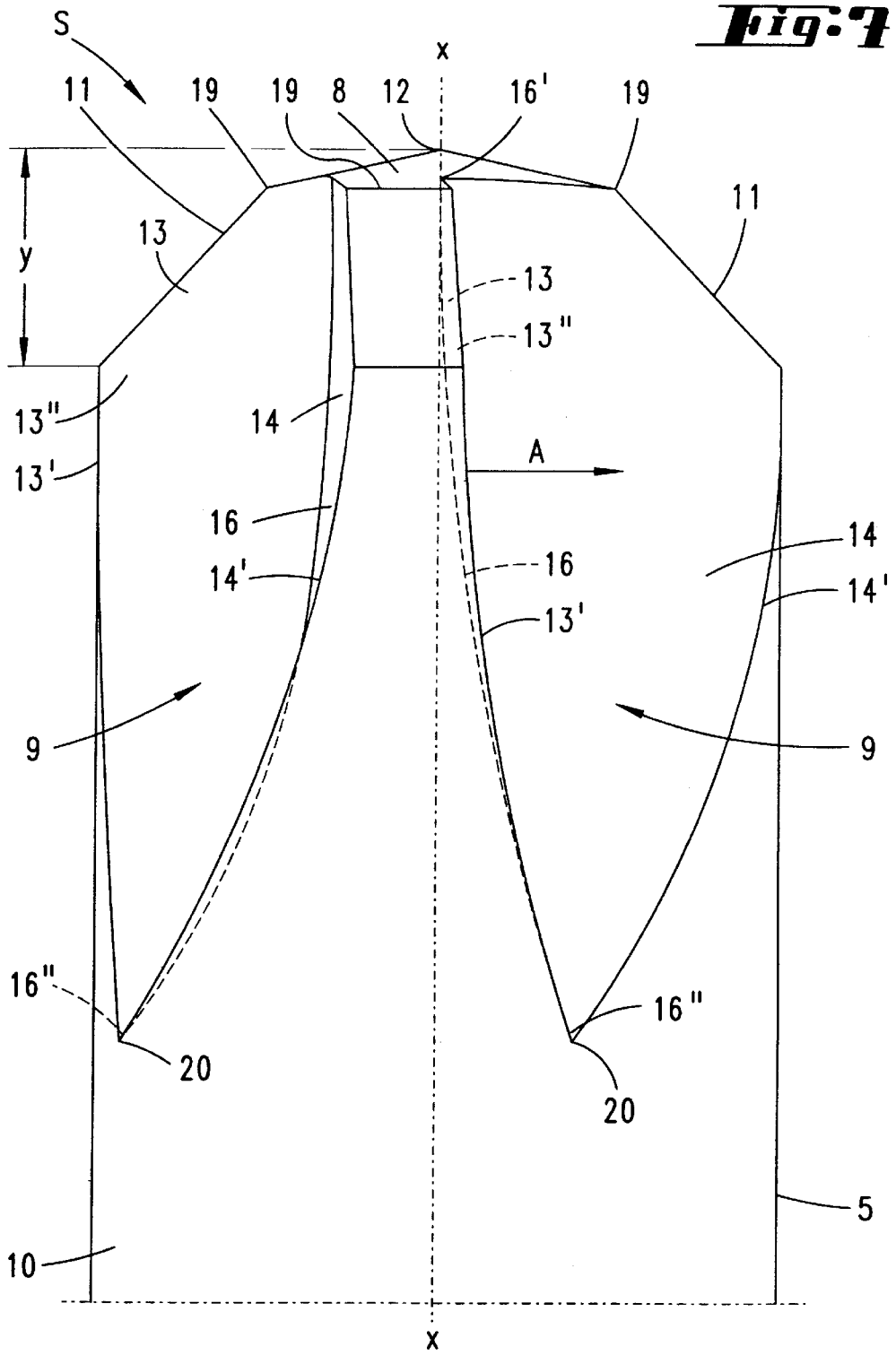
FIG. 7 shows a still further enlarged view of the output end of the screwdriver bit according to the invention.

As can be seen in particular from FIG. 7, the flanks 13, 14 of adjacent ribs 7, in the front region of the ribs 7 which approximately corresponds to the penetration depth y, are curved away from one another in the circumferential direction. On the circumferential wall side of the shank section 5 formed by the head and base region 10, this manifests itself in such a way that the notch boundary edge 13' which faces the front flank 13, in the further course, towards the shank 4, of the continuously curved flanks 13, is curved over a smaller circumferential angle alpha than the notch boundary edge 14' of the rear flank 14, which is likewise continuously curved. This larger circumferential angle is denoted by beta. The ratio is in the region of 1:3.

Figure 10:
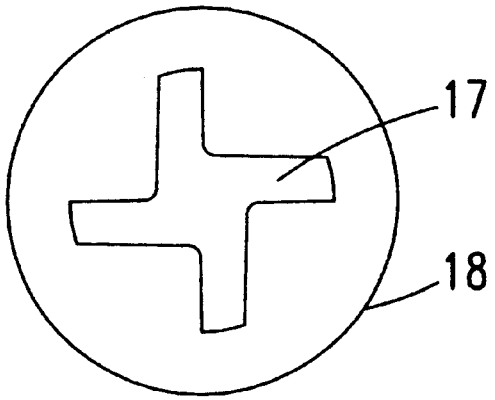
FIG. 10 shows a plan view of this screw.

The notch base 16 of each notch 9, which base likewise runs with a concave, substantially continuous curvature, extends, in the front region of the tool, at an acute angle δ to the axis of rotation x—x, close to the centre, with respect, of course, to an axis which is spatially parallel to the axis of rotation x—x, defined there by the end-face exit point 16' of the notch base 16. In terms of height, the zero point of the thinning profile lies in the centre region 8. Beyond the section of the penetration depth, i.e. of the front region of the tool, the curvature of the flanks 13 and 14 and that of the base notch 16 are still present to the extent that there is a slightly convergent arrangement of the surfaces or lines. In this way, it is possible to achieve an advantageous centring and clamping effect with regard to the cross-sectionally adapted contour of a cross slot 17 of the screw 15. The corresponding cross slot 17 is situated in the head 18 of the screw 15 (cf. FIG. 10).

Due to the different circumferential angles alpha and beta of the flanks 13, 14 of a rib 7, this rib has a face contour (13) which in the working direction ends at a shallower angle than the surface of the rear flank 14. Moreover, there is a greater accumulation of material there, and thus the rear region of the widened foot of the rib 7 is also particularly stable. The working direction is denoted by arrow A in FIG. 7. When unscrewing, the flanks 14 which have a larger surface area engage on mating flanks, which have correspondingly larger surface areas, of the cross slot 17.

Figure 8:
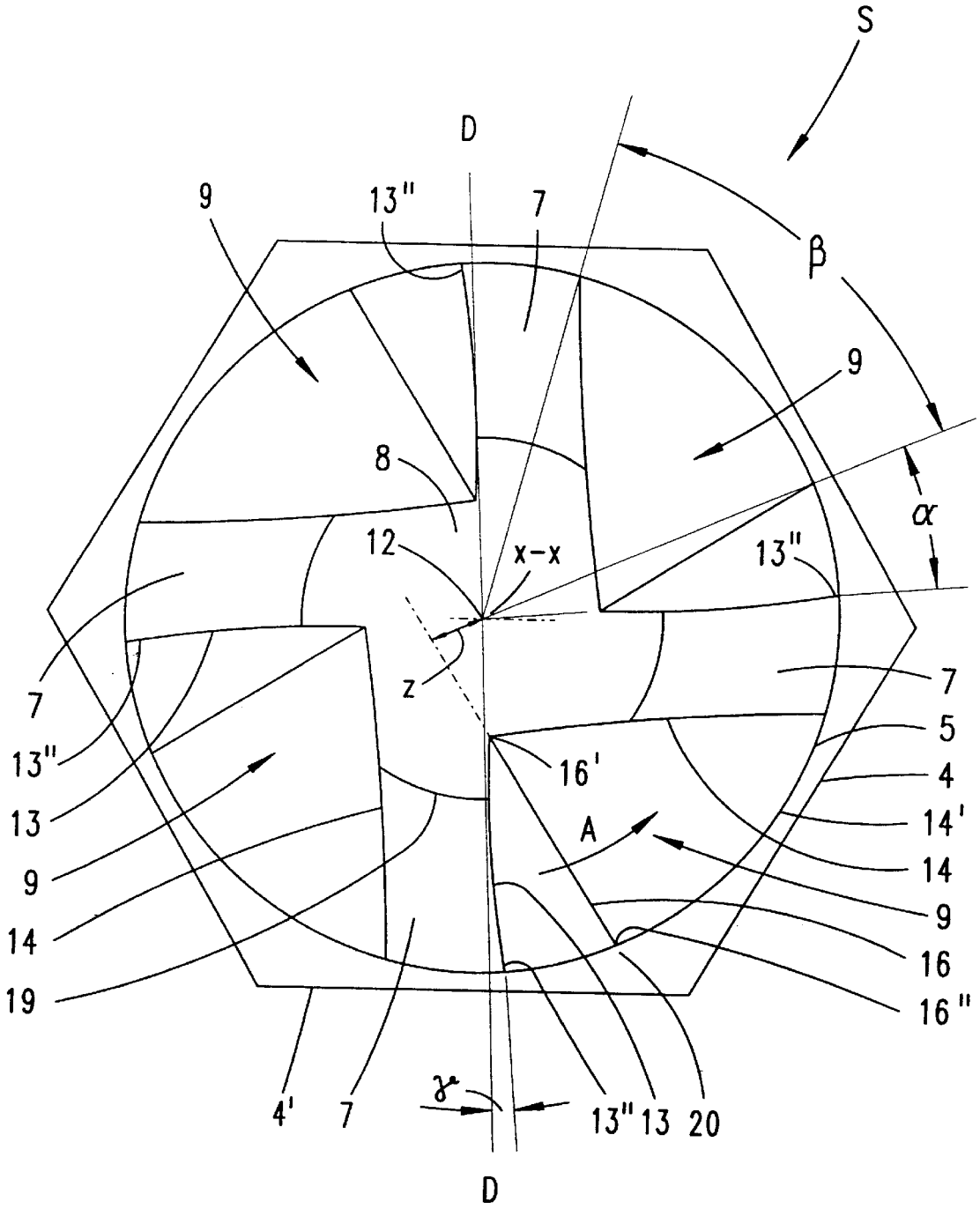
FIG. 8 shows a plan view of FIG. 7.
Figure 9:
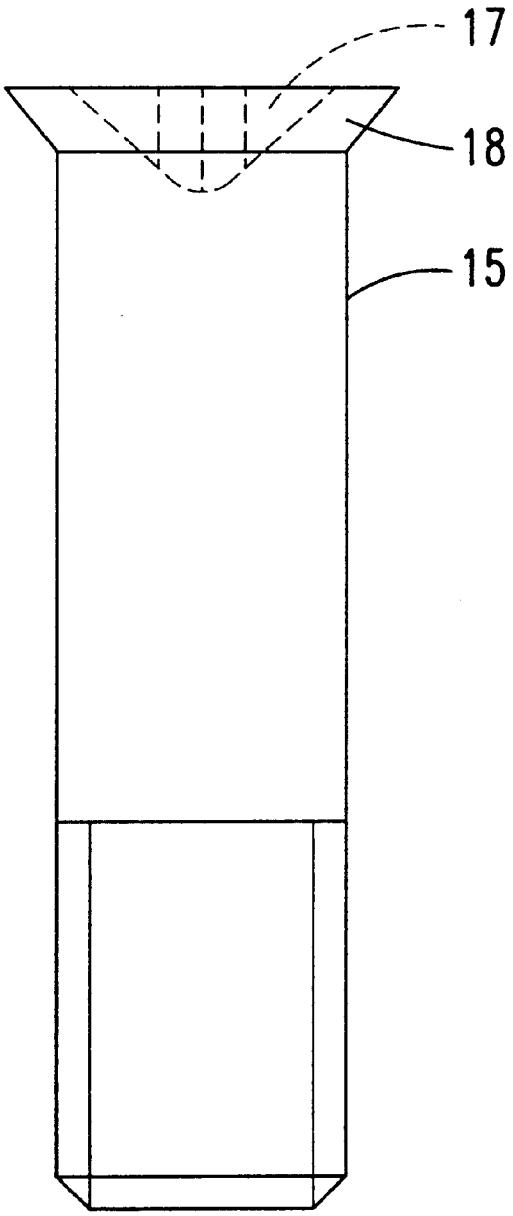
FIG. 9 shows an enlarged side view of an associated screw.

As can be seen very clearly from FIG. 8, the front flank 13 of each rib 7 has an additional curvature, specifically around the longitudinal direction of the screwdriver bit S. In practice, this leads to a hollowing of the flank 13 and to a distinct twisting of the ribs 7. As a result, the radially outer section 13' of the front region of the flank 13 which faces in the working direction A projects noticeably. The angle of twist is denoted by gamma and on the periphery leads to a forward offset of about 3° with respect to the vertical diametral plane D—D illustrated in FIG. 8. The additional curvature about the longitudinal direction which is achieved by the twisting in question can also be seen particularly clearly from FIG. 7.

Given a corresponding design of the contour of the crossed slot 17, the abovementioned section 13" does not adopt a diagonal alignment against the corresponding mating slot surface, but rather has a projecting engagement point at a location which is thus more beneficial in terms of leverage.

The rear flank 14 also has an additional, though oppositely directed curvature about the longitudinal direction of the screwdriver bit S. Correspondingly, here too there is a radially dropping outer section of the front region of the flank 14, but in this case going inwards and likewise forming a distinct hollowing in the flank 14.

The slightly conical form of the centre section 8 is adjoined by a profile which slopes down the ribs 7 approximately at an angle of 45°, for example in the form of an imaginary frustoconical surface. The obtuse-angled transition between that section of the ribs 7 which is close to the cone-base area and the peripherally adjoining, frustoconical-surface-side main region of the ribs 7 is denoted by 19.

It should also be noted, with regard to the geometry of the notches 9, that the imaginary extension of the axial projection of the notch base 16 passes the axis of rotation x—x at a distinct spacing z therefrom. The spacing z corresponds to approximately one third of the radial distance between the cone vertex and the line of the obtuse-angled transition 19. The information about this passing is meant in planar terms.

With reference to FIG. 7, it is clear that the notch base 16 ends, in the direction towards the base region 10, with notch boundaries 13', 14' which meet at an acute angle. This meeting point is denoted by 20 and coincides with the peripheral end 16" of the concavely curved notch base 16. The notch edges 13', 14' meet at an acute angle of approximately 40°.

In the manner illustrated, the cross profile 6 may advantageously be produced using the rotational production process. The appropriate profiler is known from German Patent 19 21 514 (corresponding to U.S. Pat. No. 3,715,956), the entire contents of which are incorporated herein.

The screwdriver bit which is illustrated in FIGS. 11 to 15 represents a further development with regard to the flank geometry. The features relating to this basic principle correspond to those of the basic version of the screwdriver bit S or screwdriver, for which reason the reference symbols are applied accordingly, sometimes without repeating the relevant text.

The formation is now such that the two flanks 13, 14 in the front region of each rib 7, starting from a parallel flank section **7*a* which enters the insertion profile, i.e. cross slot 17, of the screw head 18, are curved away from one another in the axial direction. The beginning of the curvature of the rib 7 is denoted by 7*b*. This may denote a continuous follow-on to the curved parts of the flanks 13, 14 or a trapezium flank section 7*c*. The wider base of the trapezium flank section 7*c* faces towards the shank section 5 of the tool. The angles of the trapezium flanks may be steeper at 13 than at 14**.

Figure 15:
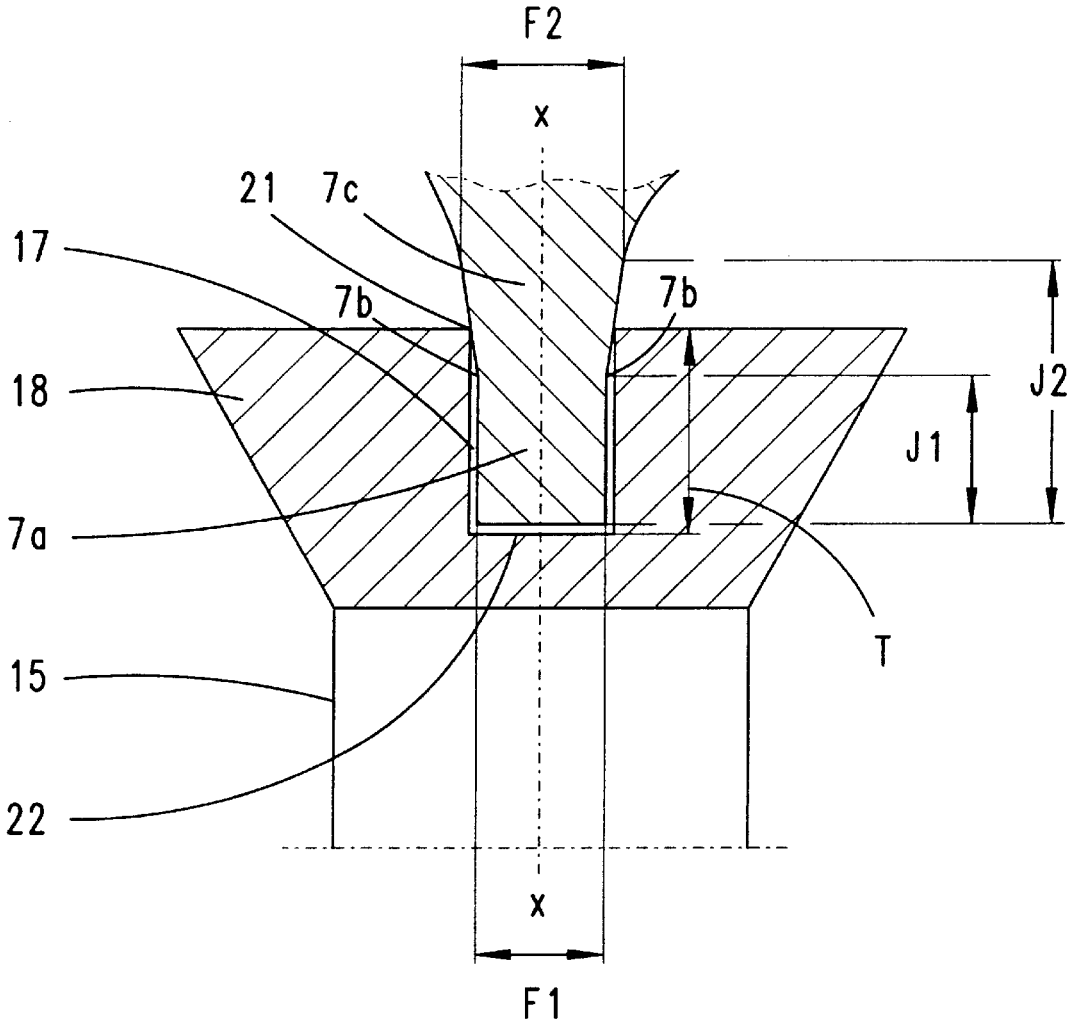
FIG. 15 shows a section through a screw with a rib of the screwdriver inserted into it.

The beginning **7*b* of the curvature has been fitted into the screw 15 in the region of the opening 21 of the insertion profile of the screwhead 18, cf. FIG. 15. The corresponding narrowing, towards the cone vertex 12, of the trapezium flank section 7*c*, and the parallel flank section 7*a*, which connects with the trapezium flank section 7*a* at the head width of the trapezium flank section 7*c*, assist with fitting these parts together, due to the initially greater play which is followed by flush contact in the region of the opening 21**.

The cone vertex 12 sticks out from the base 22 of the insertion profile, i.e. of the cross slot 17. The ratios are such that the distance between the cone vertex 12 and the beginning **7*b* of curvature is less than the penetration depth T into the penetration profile of the screwhead 18**.

In FIG. 15, for reasons of improved understanding, the corresponding difference is based on a base line which marks the transition region between the front part 11 and the frustoconical centre section 8. The actual load-bearing area of the flanks 13, 14 begins from there and runs towards the shank 5.

Therefore, FIG. 13 shows a reference plane E—E which corresponds to the frustoconical-surface wall side main region of the ribs 7 and is denoted by 19. Accordingly, the subject matter as further developed is geometrically designed in such a way that the flanks of the parallel flank section **7*a* lie on an axial length J1. Only after the length J1** do the flanks of the trapezium flank section 7*c* run out to the defined length J2 illustrated in the drawing, with two blade-head feed angles (measured by orientations of tangent planes to the surfaces of the flanks of a rib at the location of FIG. 13) to a width F2 (cf. FIG. 12). The corresponding blade-head feed angles (angulation of tangent planes to the surfaces of the flanks of a rib at the location J2 of FIG. 13) are illustrated in FIGS. 13 and 14. The blade-head feed angle of FIG. 13 is 8.24° (not shown), while the blade-head feed angle of FIG. 14 is 4.7° (not shown). The latter thus starts from the line of the notch base 16. At the level of the profile depth T of the screw head insertion profile, the width F2 of the rib 7 is greater than that of the insertion profile.

Figures 11, 12:
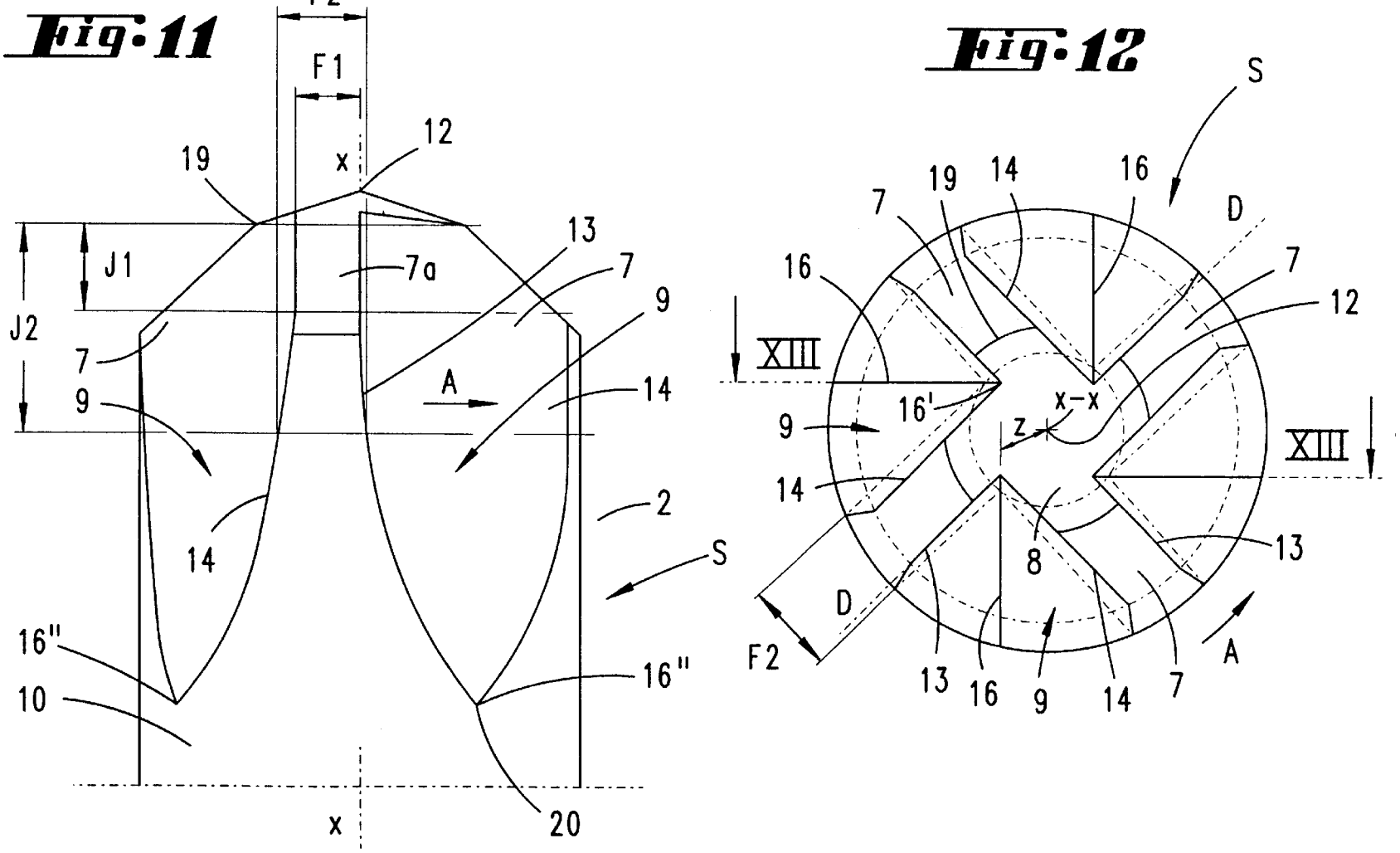
FIG. 11 shows an enlarged side view of a screwdriver bit which represents a further development.
FIG. 12 shows a plan view of FIG. 11.

As can be seen particularly clearly from FIG. 12, the trapezium flanks or curvature surfaces which adjoin the parallel flank section 7*a* in the direction of the shank 5 are twisted, specifically on both sides. The twist on the flank 14 is more pronounced towards the periphery than that of the flank 13 which lies in the working direction A, in other words: the front and rear curvature surfaces are twisted to unequal extents in the same direction. In FIG. 12, the initial contour from depth J2 (see FIG. 13) is illustrated in dot-dashed lines. The trapezium flank sections 7*c* or surface sections which diverge in a curve towards the vertex 12 extend between the rib-side continuous line and the dot-dashed line. While those surfaces which face the rear flank 14 narrow continuously towards the notch base 16, those regions which are adjacent to the front flank 13 narrow towards the periphery. Beyond a minimum width F1, which is shown in FIG. 11, of the ribs 7, the latter merge relatively quickly into the greater width F2 over a longitudinal section J2 minus J1. J1 corresponds to one half to one third of J2.

Those edges of the flanks 13 which spread out remote from the shank, i.e. at the output end 2, given the four-ribbed design illustrated, up to the periphery lie predominantly in a common diametral plane D—D. The trapezium flank profile or the curvature which is also steeper at this front flank 13 emerges from a comparison of the angles shown in FIG. 11, the values of which are shown in that figure.

What is claimed is:

1. Screwdriver or screwdriver bit (S), having an input end (1), an output end (2) and a shank (4) located between these ends, the shank extending in a longitudinal direction along an axis of rotation of the screwdriver or the bit from the input end to the output end, the output end being forward of the shank and including a centre section (8) disposed at a forward part of the output end and extending transversely of the axis, wherein the output end is profiled in the form of a group of ribs spaced apart by notches and having at least three ribs (7), which ribs (7) extend from the centre section (8) radially outward from the axis of rotation and longitudinally parallel to the axis, each rib having a front flank (13) and a rear flank (14) wherein the front flank is ahead of the rear flank in a clockwise direction of rotation of the screwdriver or bit about the axis, the rear flank of one of the ribs and the front flank of a successive one of the ribs defining one of the notches of which a base of the notch extends between said one of the ribs and said successive one of the ribs, wherein a front part of each of the ribs is oriented at an angle to the axis of rotation, the front and the rear flanks in a forward region of each of the ribs run substantially parallel to one another, in which forward region of each rib a substantially tangent surface with respect to each front flank (13) lies on a diametral surface through the axis of rotation, wherein each of the notches (9) runs in said longitudinal direction, wherein said front flank and said rear flank (13, 14) of each of the ribs are curved away from one another such that in each of said notches, a boundary outer edge (13') of the front flank (13), in a further course of a curvature of the front flank (13) in a direction of the axis, is curved towards the notch base over a smaller circumferential angle than a further notch boundary edge (14') of the rear flank (14).

2. Screwdriver or screwdriver bit, having an input end (1), an output end (2) and a shank (4) located between these ends, the shank extending in a longitudinal direction along an axis of rotation of the screwdriver or the bit from the input end to the output end, the output end being forward of the shank and including a centre section (8) disposed at a forward part of the output end and extending transversely of the axis, wherein the output end is profiled in the form of a group of ribs spaced apart by notches and having at least three ribs (7), which ribs (7) extend from the centre section (8) radially outward from the axis of rotation and longitudinally parallel to the axis, each rib having a front flank (13) and a rear flank (14) wherein the front flank is ahead of the rear flank in a clockwise direction of rotation of the screwdriver or bit about the axis, the rear flank of one of the ribs and the front flank of a successive one of the ribs defining one of the notches of which a base of the notch extends between said one of the ribs and said successive one of the ribs, wherein a front part of each of the ribs is oriented at an angle to the axis of rotation, the front and the rear flanks in a forward region of each of the ribs run substantially parallel to one another, in which forward region of each rib a substantially tangent surface with respect to each front flank (13) lies on a diametral surface through the axis of rotation, wherein each of the notches (9) runs in said longitudinal direction, wherein said front flank and said rear flank (13, 14) of at least one of the ribs, starting from a boundary edge of the front part (11), are curved away from one another, the front flank (13) having a curvature and extending in the longitudinal direction, and a front region of the front flank (13) having a radially projecting outer section (13") wherein, a notch boundary edge (13') of the front flank (13) of one of the ribs, in a further course of the curvature of the front flank is curved over a smaller circumferential angle than a notch boundary outer edge (14') of the rear flank (14).

3. Screwdriver or screwdriver bit according to claim 2, wherein the rear flank (13) in at least one of the ribs includes a radially extending section (14'), said radially extending section (14') having an additional concave curvature positioned in a forward region of the rear flank.

4. Screwdriver or screwdriver bit, having an input end (1), an output end (2) and a shank (4) located between these ends, the shank extending in a longitudinal direction along an axis of rotation of the screwdriver or the bit from the input end to the output end, the output end being forward of the shank and including a centre section (8) disposed at a forward part of the output end and extending transversely of the axis, wherein the output end is profiled in the form of a group of ribs spaced apart by notches and having at least three ribs (7), which ribs (7) extend from the centre section (8) radially outward from the axis of rotation and longitudinally parallel to the axis, each rib having a front flank (13) and a rear flank (14) wherein the front flank is ahead of the rear flank in a clockwise direction of rotation of the screwdriver or bit about the axis, the rear flank of one of the ribs and the front flank of a successive one of the ribs defining one of the notches of which a base of the notch extends between said one of the ribs and said successive one of the ribs, wherein a front part of each of the ribs is oriented at an angle to the axis of rotation, the front and the rear flanks in a forward region of each of the ribs run substantially parallel to one another, in which forward region of each rib a substantially tangent surface with respect to each front flank (13) lies on a diametral surface through the axis of rotation, wherein each of the notches (9) runs in said longitudinal direction, wherein said front flank and said rear flank (13, 14) of at least one of the ribs, starting from a boundary edge of the front part (11), are curved away from one another, the front flank (13) having a curvature and extending in the longitudinal direction, and a front region of the front flank (13) having a radially projecting outer section (13") Screwdriver or screwdriver bit wherein, the rear flank (14) of at least one of the ribs includes a radially extending section (14') positioned in a front region of the rear flank, said radially extending section (14') having an additional concave curvature.

5. Screwdriver or screwdriver bit according to claim 1, wherein the front flank (13) in at least one of the ribs includes a radially extending section (13") positioned in a forward region of the front flank, said radially extending section (13") having an additional curvature.

6. Screwdriver or screwdriver bit according to claim 1, wherein the rear flank (14) of a rib includes a radially extending section (14'), said radially extending section (14') having an additional concave curvature positioned in a forward region of the rear flank.

7. Screwdriver or screwdriver bit according to claim 5, wherein the rear flank (14) of a rib includes a radially extending section (14') having an additional curvature positioned in a forward region of the rear flank (14).

8. Screwdriver or screwdriver bit according to claim 1, wherein said front and said rear flanks (13, 14), in the forward region of each rib (7), beyond a section of flank **(7*a*) which enters into an insertion recess of a screw head (18) of a screw (15), and directly adjoins a front-part boundary edge, are curved away from one another in an axial direction, a beginning (7*b*) of the curvature lying in a region of an opening (21)** of the insertion recess.

9. Screwdriver or screwdriver bit according to claim 1, wherein an acute angle is formed between the notch base and a line (x—x) extending through an end face exit point (16') of the notch.

10. Screwdriver or screwdriver bit according to claim 1, wherein front parts (11) of the ribs form sections of an imaginary frustoconical surface.

11. Screwdriver or screwdriver bit according to claim 1, wherein an imaginary extension of an axial projection of each notch base (16) passes the axis of rotation at a distance (z) therefrom.

12. Screwdriver or screwdriver bit according to claim 1, wherein the notch base (16) ends with notch boundaries (13', 14') which meet at an acute angle.

13. Screwdriver or screwdriver bit according to claim 1, wherein the notch boundaries (13', 14') meet approximately at an angle of 40°.

* * * * *